United States Patent [19]

Spratt

[11] Patent Number: 4,679,415

[45] Date of Patent: Jul. 14, 1987

[54] LOCKING MECHANISM FOR LIGHTWEIGHT SECURITY CABINET

[75] Inventor: Kenneth Spratt, Provo, Utah

[73] Assignee: Thomas A. James, Mapleton, Utah

[21] Appl. No.: 806,826

[22] Filed: Dec. 10, 1985

[51] Int. Cl.[4] ..... E05B 63/14

[52] U.S. Cl. ..... 70/118; 70/1.5; 292/39; 109/59 R

[58] Field of Search ..... 292/32, 39; 70/118–120, 1.5; 109/59

[56] References Cited

U.S. PATENT DOCUMENTS

| | | | |
|---|---|---|---|
| 97,581 | 12/1869 | Worrell et al. | 70/118 |
| 341,728 | 5/1886 | Caron | 70/118 |
| 343,794 | 6/1886 | Brown | 292/39 X |
| 1,190,439 | 7/1916 | Marchfeld | 70/120 X |
| 1,504,176 | 8/1924 | Wright | 292/39 |
| 2,787,154 | 4/1957 | Wesberry | 70/118 |
| 3,223,057 | 12/1965 | Lingal | 109/59 |
| 3,371,628 | 3/1968 | McClellan | 109/59 |
| 4,520,736 | 6/1985 | Crosby et al. | 70/1.5 X |

FOREIGN PATENT DOCUMENTS

| | | | |
|---|---|---|---|
| 126342 | 1/1932 | Austria | 109/59 |
| 7350 | 2/1911 | United Kingdom | 70/118 |

*Primary Examiner*—Robert L. Wolfe

*Attorney, Agent, or Firm*—Trask, Britt & Rossa

[57] ABSTRACT

A locking mechanism which includes a rack-and-pinion-type gearing arrangement positioned on the interior surface of a security cabinet door surface is disclosed. The pinion-type gear is made rotatable by a shaft affixed thereto which communicates with the exterior surface of the door. The rack portion of the gearing arrangement is fixedly mounted to a plurality of shaft-like members which are adapted to be slidably displaced along the interior surface of the door. The shaft-like members position a plurality of bolt-like members about the perimeter of the door and function to extend those bolt-like members beyond the perimeter of the door and thereby secure the door when it is in a closed position. A bolt-like locking mechanism is positioned in conjunction or proximity to the shaft-like extensions whereby the locking mechanism may be employed to preclude the further displacement of the shaft-like extensions and thereby maintain the safe in a secured, locked position.

3 Claims, 5 Drawing Figures

LOCKING MECHANISM FOR LIGHTWEIGHT SECURITY CABINET

BACKGROUND OF THE INVENTION

1. Field

This invention is directed to a lightweight security cabinet or safe having a locking mechanism on the interior face of the door of that cabinet. More particularly, this invention is directed to a locking mechanism adapted to position a series of bolt-like members about the perimeter of the cabinet door in order to secure it in a locked condition.

2. State of the Art

Security cabinets or lightweight safes have long been known. These cabinets are frequently used in private residences to store and secure valuables such as jewelry, private papers, and fire arms, especially pistols and hand guns. Due to the value of the contents stored in these safes, extensive efforts have been made in the past to develop locking mechanisms for these cabinets which mechanisms are not susceptible to tampering.

A typical locking mechanism is that which is shown in U.S. Pat. No. 3,076,420 to McClellan. The basic mechanism of the McClellan device utilizes a plate-like member mounted on the interior surface of the door. The plate is positioned to rotate about an axis which extends essentially perpendicular to the planar interior face of the door. Positioned pivotedly on the plate proximate the perimeter of the plate are a series of rod-like extension members which are connected to shafts which extend essentially along the full width or length of the door. To secure the safe, these shafts are extended beyond the perimeter of the door when the plate is in a closed orientation. In operation, the plate is made to rotate about its axis under the action of an exteriorly accessible lever or handle. When the lever or handle is rotated, the plate in turn also rotates and results in the extension arms being either extended beyond the perimeter of the door or retracted so as to not extend beyond that perimeter. When the shafts are extended beyond the perimeter, the safe is in locked position; i.e., the shafts extend beyond the perimeter of the door and are positioned in an abutting orientation against a marginal face or frame of the door such that any attempt to swing the door open results in the shaft abutting against the frame of the door and thereby precluding any further outwardly directed motion or displacement of the door panel itself.

An alternate embodiment or construction similar to that of McClellan is shown in U.S. Pat. No. 2,860,584 to Deaton, et al. The Deaton device discloses the use of a geared plate which is made rotatable about an axis which extends perpendicular to the interior surface or face of the door panel. The geared plate is made mechanically intercooperable with a secondary driven gear. A plate-like member is fixedly mounted on the secondary driven gear. A series or plurality of extension members, the displacement of which occasions the outward extension or positioning of bolts into an abutment or securing position against the frame of the door are mounted on this plate-like member.

Alternate constructions disclosing the use of a plate-like member which, in effect, rotates in a plane which is parallel to the interior surface or face of the door are shown in U.S. Pat. Nos. 1,870,746 to Pyle and 1,122,550 to Stevens.

SUMMARY OF THE INVENTION

A locking mechanism of the instant invention includes a first driven gear which is positioned on the interior face of a security cabinet door and made rotatable generally in a plane which is parallel to the interior surface of the security cabinet door; i.e., the first driven gear is rotated about an axis which extends perpendicular to the surface of the security cabinet door.

The first driven gear is made manipulatable and mechanically cooperable with an exteriorly accessible actuation means which may typically include a lever, or alternately a spoked ring handle. In a preferred embodiment, the exteriorly positioned handle or lever is fixedly mounted on a shaft which extends through the security cabinet door by means of an aperture defined within the door. The shaft is fixedly mounted upon the first driven gear whereby a rotation of the handle or lever effects a rotation of the first driven gear. The first driven gear is made mechanically cooperable with a second driven gear; i.e., the teeth or other means associated with each gear are made mechanically cooperably whereby a displacement or rotation of the first driven gear operates to occasion a rotation of the second driven gear.

Similarly to the configuration of the first driven gear, the second driven gear is made rotatable about an axis which extends essentially perpendicular to the interior planar face of the security cabinet door. The second driven gear is adapted with means whereby it is made mechanically cooperable with at least one, but preferably a plurality of, rack-type gears whereby the rotation of the second driven gear operates to displace the rack-type gears in an essentially linear displacement along a predetermined direction over the interior surface of the cabinet door.

Each of the rack-type gears are fixedly mounted upon a respective shaft-like extension which is housed within support means fixedly mounted on interior surface of the security cabinet door. The shaft-like extensions are thereby made displaceable essentially along the surface of the security cabinet door in generally linear directions. The shaft-like extensions are each fitted with one or alternately a plurality of bolt-like members which are positioned proximate the perimeter of the security cabinet door. A displacement of the shaft-like extensions operates to position the bolt-like members in an abutting relationship with the frame which circumscribes the cabinet door. When the bolt-like members are extended when the door is in a closed position, this abutting relationship precludes the opening of the door.

In some constructions, the first and second driven gear are combined; i.e., the first and second driven gear are the same gear such that the exteriorly positioned lever operates to rotate directly the first driven gear and thereby achieve a direct interrelationship between the first driven gear and the rack-type gears.

A locking mechanism which is adapted to preclude the further displacement of the driven gear is mounted in close proximity to the mounting gear and adapted such that the user may manipulate the locking mechanism from the exterior of the cabinet door face and thereby achieve a condition wherein the driven gear is unable to be rotated about its axis, thereby securing the positioning of the perimeter positioned bolts in a fixed, cabinet-locking orientation.

DESCRIPTION OF THE ILLUSTRATED EMBODIMENTS

Figure 1:
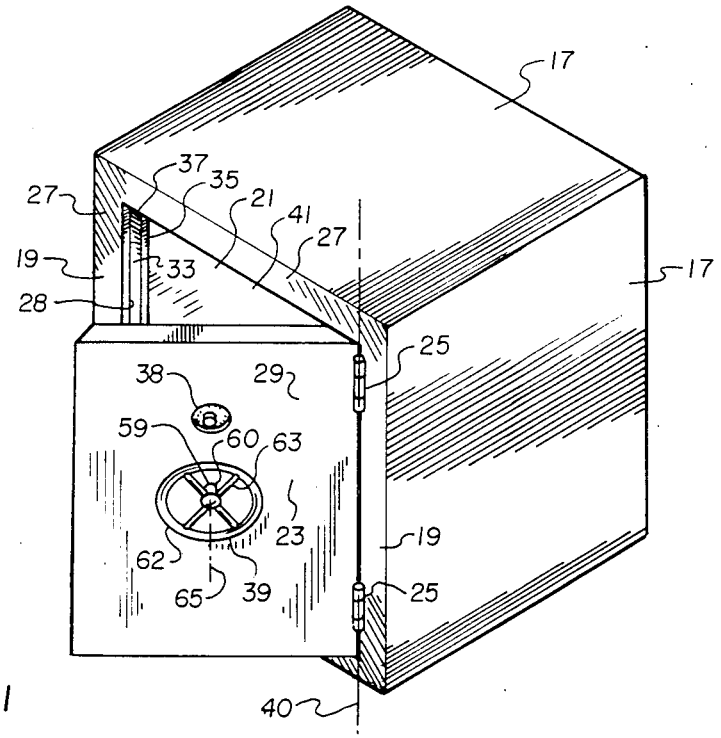
FIG. 1 is an elevated perspective view of the frontal portions of a security cabinet showing a door positioned within a marginal door-outlining frame assembly. A locking mechanism together with its attendant actuating mechanism is illustrated on the face of the door.

As shown in FIG. 1, a security cabinet of the instant invention includes a series of essentially planar wall surfaces, generally 17, which are joined together at their ends to define an essentially box-like configuration. One of the sides of the safe, generally 19, is defined as the door-retaining wall of the safe. As shown, this door-retaining wall may include an essentially rectangular configured opening 21 which is dimensioned to receive a planar door 23. Door 23 is pivotedly affixed to the exterior of door-retaining wall 19 by means of a plurality of hinge members 25. Door-retaining wall 19 defines a marginal front face or frame 27 which circumscribes the perimeter of opening 21. Door 23 is an essentially planar panel having a planar front exterior surface 29 and similarly an interior planar surface 31 which is essentially oriented parallel to the exterior surface 29.

The door-retaining wall 19 may include a channel, generally 33, which is positioned adjacent the exterior surface 29 of the frame 27. The channel 33 is defined by the void 37 between the frame 27 and a secondary, parallel positioned wall 35. Positioned on the exterior surface 29 of the door 23 is a lock control means, generally 38, and an actuation means, generally 39. Lock control means 38 may be a key lock, a combination lock, or other locking system known in the art. In operation, a user may open the safe by manipulation of the actuation means 39 in conjunction with the lock control means 38 whereby a plurality of bolt-like retaining means are retracted from their positions within channel 33, forming an abutting condition against the interior surface 28 of frame 27 in those constructions which do include a defined channel 33. When the retaining means are retracted to an open position, the user is permitted to exert an outwardly directed force on actuation means 39, thereby occasioning the rotation of the door 23 about its axis 40 on hinges 25. Thereafter, the user may access the interior 41 of the safe together with its contents.

Figure 3:
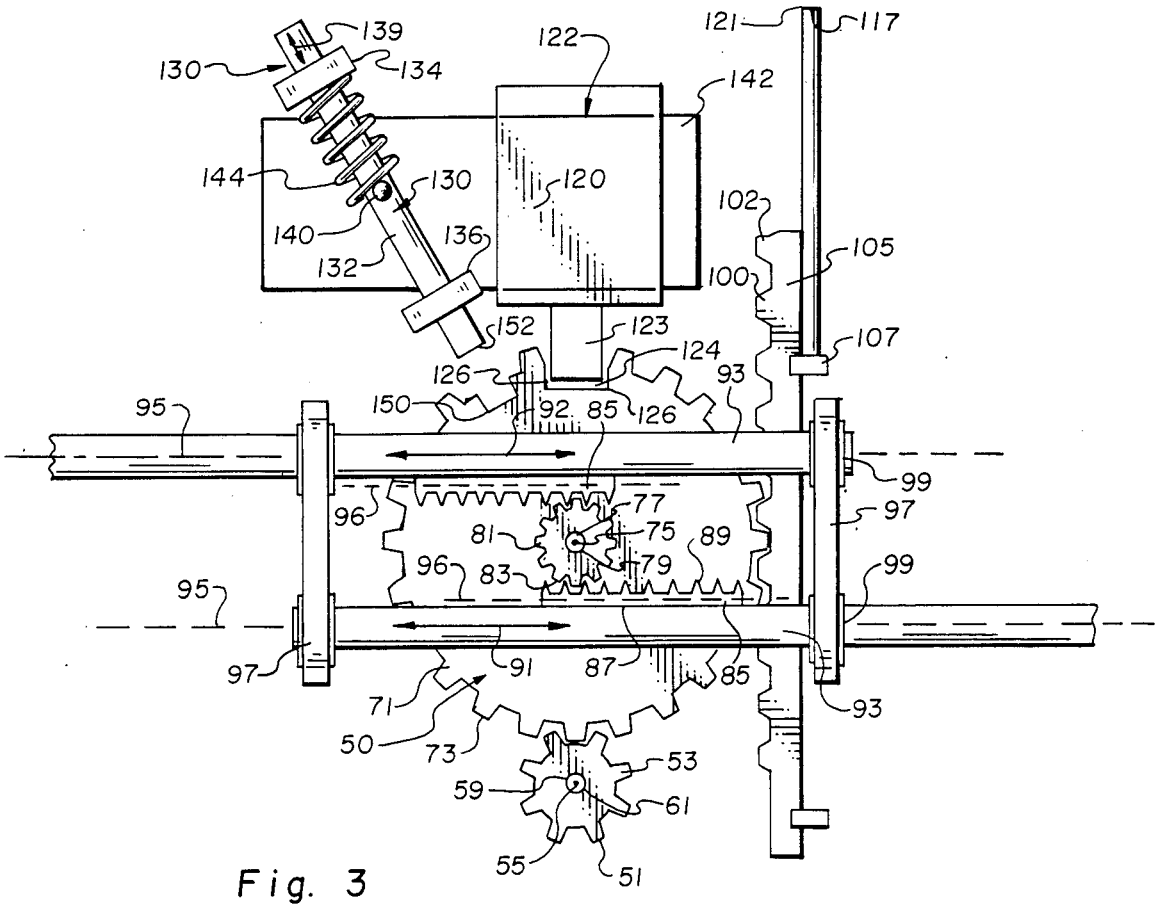
FIG. 3 shows a locking mechanism for use on the interior planar surface of a security cabinet door, including a plurality of intercooperating gears.
Figure 4:
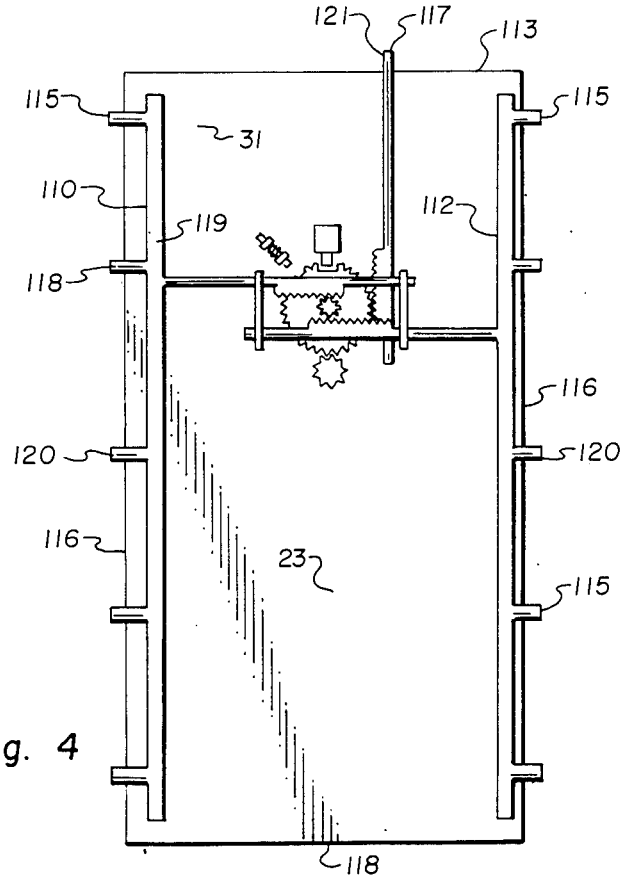
FIG. 4 illustrates the locking mechanism of FIG. 3 positioned on the interior face of a security cabinet door.

A preferred embodiment of the instant invention is that shown in FIGS. 3 and 4. The interiorly mounted locking system, generally 50, includes a first driven gear 51 which may be essentially a flat, circular cross-sectioned gear having a plurality of teeth 53 fixedly mounted about the circumference of first driven gear 51. More particularly, first driven gear 51 may be a pinion gear having an axis of rotation 55, which axis extends perpendicular to the plane of the interior surface 31 of door 23. First driven gear 51 rotates in a plane which is essentially parallel to the plane of the interior surface 31 of door 23. The first driven gear 51 is fixedly mounted upon a shaft 59. Shaft 59 may be generally cylindrical in configuration and extends through an aperture 61 in the door 23. Aperture 61 extends through the entire thickness of door 23. Shaft 59 extends through the exterior surface 29 of the door 23 and is fixedly mounted upon actuation means 39. Shaft 59 may be mounted within bearings 60 which are housed within the door-defined aperture 61.

As shown in FIG. 1, actuation means 39 may be configurated in a generally spoked wheel-type configuration having a series of radiating spoke-like members 63 in conjunction with a rim 62. Spokes 63 may be fixedly mounted to the shaft 59 at a point which is essentially the center of the rim 62. In operation, a rotation of actuation means 39 about its axis 65 occasions a similar rotation of the first driven gear 51 about its axis 55.

First driven gear 51 is dimensioned and configured to be mechanically cooperable with a second driven gear 71. Second driven gear 71 may also be a flat planar gear having a plurality of teeth 73 positioned upon the circumference of the essentially circular cross-sectioned gear body. Second driven gear 71 rotates about an axis 75 which is perpendicular to the interior face 31 of door 23.

The second driven gear 71 is mounted rotatably on a shaft 77 which is fixedly mounted to interior surface 31 of door 23. Further, shaft 77 extends perpendicularly from interior surface 31 of door 23. Shaft 77 is essentially cylindrical in configuration and dimensioned so as to be fitted within a cylindrical recess well or aperture 79 defined by the structure of second driven gear 71. Gear 71 may be held in position on shaft 79 by means of a snap ring or similar attachment means.

In the preferred configuration, as shown in FIG. 3, an auxiliary gear 81 is fixedly and securely mounted to second driven gear 71 such that both gears 71 and 81 rotate about a common axis 75. Auxiliary gear 81 is similar in construction to second driven gear 71 in that it includes a gear structure having teeth 83 positioned about the circumference of an essentially circular cross-sectioned planar gear body.

The teeth 83 of auxiliary gear 81 are dimensioned and configured to mechanically cooperate with at least one or, as shown, a pair or more of rack gears 85. The positioning of rack gears 85 about auxiliary gear 81 may be as shown in FIG. 3; i.e., the gears are positioned diametrically opposite one another about the auxiliary gear 81. Rack gears 85 are generally elongate members 87 configured with a plurality of teeth 89 which extend along the longitudinal length of planar member 87. Teeth 89 are dimensioned and configured to be mechanically cooperable with teeth 83. Further, teeth 89 are positioned in conjunction with auxiliary gear 81 such that a rotation of auxiliary gear 81 results in a lateral or linear displacement of the rack gears 85 along the interior surface 31 of door 23 in those directions indicated by arrows 91 and 92.

The rack gears 85 are each securely fastened to a respective shaft 93. Shafts 93 are essentially elongate members which may have a longitudinal axis 95 which is parallel with the longitudinal axis 96 of the respective rack gear 85. Shafts 93 are held in position by a series or plurality of support members 97 which support members are securely fastened to the interior surface 31 of door 23. Support members 97 are of a type commonly used in the art to support and direct the motion of shaft or rod over an extended distance. Support members 97 may each include an essentially "L"-shaped or, alternately, "U"-shaped cross-section structure which defines a channel 99 adapted to receive and slidably support the displacement of shafts 93 along the directions indicated by arrows 91 and 92.

A second rack gear, denoted generally 100, is configured with teeth 102 which are adapted to cooperate with the teeth 73 of second driven gear 71. As shown, the rack gear 100 is fixedly mounted to a shaft 105 which is supported by supports 107, which supports 107 are structurally similar to supports 97 of shafts 93.

Shaft member 105, together with its attendant rack gear 100, is positioned such that a rotation of second driven gear 71 occasions a lateral or linear displacement of the shaft member 105 along the directions indicated by arrow 109. As shown, the directions indicated by arrow 109 are essentially perpendicular to the direction indicated by the arrows 91 and 92.

Shafts 93 and shaft 105 are dimensioned in width such that each shaft may be displaced without contacting either of the other shafts; e.g., shaft 105 is dimensioned such that shaft 93 may pass below it (as seen in plan view) without contacting shaft 105.

As shown in FIG. 4, shafts 93 are fitted at their respective ends to elongate shaft members 110 and 112. Shaft members 110, 112 are oriented essentially perpendicular to shafts 93 and extend generally along the sides of the door 23 proximate the edge of that door. As shown in FIG. 4, shaft members 110, 112 may extend the full height of door 23. Alternately, the shafts 110, 112 may be dimensioned to be less than the full height of door 23. Shaft members 110, 112 are themselves fitted with a plurality of bolt-like members 115 which bolt members are positioned proximate the edges 116 of the door 23.

As shown in FIG. 4, shaft 105 may be dimensioned such that it functions similarly to the bolt-like members 105 in being positionable within or beyond the perimeter 118 of door 23. Alternately, shaft 105 may be fitted with an elongate member such as shafts 110 and 112.

The bolts 115, or alternately the end 117 of shaft 105, may be positioned in two distinct positions—a first position wherein the ends or tips 120 of bolts 115 and end portion 117 of shaft 105 are extended beyond the perimeter 118 of door 23, and a second position wherein the ends or tips 120 of the respective bolts 115 and end portion 117 of shaft 105 are positioned within the perimeter 118 of door 23. As may be comprehended by resort to FIGS. 1 and 4, as the bolt member 115 and end portion 117 of shaft 105 are positioned beyond the perimeter 118 of door 23 when the door is in a closed position, the bolts 115 and the shaft 105 are positioned within channel 37, or alternately in an abutting contact with the interior surface 28 of frame 27. In this orientation, the bolts 115 and shaft 105 prevent a user from opening door 23 until the bolts are retracted, i.e. withdrawn within the perimeter of door 23.

A dead-bolt locking mechanism, generally 122, is mounted on interior surface 31 of door 23 and is positioned proximate the second driven gear 71. The dead-bolt lock is of a type commonly known in the art. The dead-bolt locking mechanism 122 is made accessible from the exterior of the safe through lock control means 37. The dead-bolt locking mechanism 122 includes means, generally a shaft member which extends through an aperture 119 within the wall of door 23, and is made mechanically cooperable with a dial, a key lock mechanism, or other conventional lock control apparatus, which is positioned exterior to or alternately within the wall of door 23. Lock control means 38 is accessible and manipulatable from the exterior of the cabinet.

As shown, dead-bolt lock locking mechanism 122 includes a bolt member 123 which is displaceable so as to enter within a recess 124 defined by the structure of second driven gear 71. As shown in FIG. 3, this recess may be defined as an essentially "U"-shaped indentation within the perimeter of the second driven gear 71. This indentation is adapted to receive the bolt-like member 123 while also offering two abutment walls 126 and 128 such that upon the positioning of bolt member 123 within the recess 124, a rotation of second driven gear 71 is essentially precluded by the abutting action of abutment walls 126 and 128 against bolt member 123.

Bolt member 123 is positionable in two distinct positions—a first position which is shown in FIG. 3 in which the bolt member 123 is inserted within the recess 124 and thereby precludes the further rotation of second driven gear 71, and a second position (not shown) wherein bolt member 123 is retracted from within the recess 124 to a position such that the second driven gear 71 is free to rotate without abutting against the bolt member 123.

As shown in FIG. 3, a secondary securement system, generally 130, is shown in which an essentially shaft-like member 132 is held in a slidable position by two support members 134 and 136. Support means 134, 136 are similar in construction to supports 97 and are securely fastened to the interior surface 31 of door 23. Support members 134 and 136 each define a channel which permits shaft 132 to slide through the supports 134 and 136 in the directions indicated by arrow 138, i.e. essentially parallel to interior surface 31 of door 23.

Shaft 132 is retained in the position shown in FIG. 3 by the action of a support pin 140. Support pin 140 is fixedly mounted on shaft 132. A plate 142 is positioned over pin 140 and bolt locking mechanism 122. Pin 140 may either be mounted on plate 142 or abutted against plate 142 sufficiently that pin 140 is retained in position due to the forces generated by that abutment. A spring 144 is positioned against the support 134 and is held in compression against pin 140.

The second driven gear 71 is essentially adapted with a second recess or indentation 150 which is "U"-shaped in configuration and dimensioned to receive the tip or end portion 152 of shaft 132 such that upon a displacement of the shaft 132 in the direction indicated by arrow 139, the tip 152 is inserted within second indentation 150 and provides a secondary restriction upon any rotation of second driven gear 71.

Should the safe be tampered with by displacing the bolt locking mechanism 122 into the interior of the safe, such as by chiseling, striking or impacting the lock control means 38, such a blow, in forcing the bolt locking means 122 into the interior of the safe, would displace the plate-like member 142. Upon its displacement, the support pin 140 would be disjoined from the plate 142. The compression action of the spring 144 against the support member 140 would no longer be restrained by plate 142, whereupon the spring 144 would force the shaft member 132 in the direction indicated by arrow 139 such that tip 152 enters into recess well 150. Thereafter the recess walls 161 and 162 of recess well 150 would preclude, due to their abutting action against tip 152 and shaft 132, the further rotation of second driven gear 71. This second locking means provides a means of securing the safe against its opening after the forced displacement of the locking means 122.

Figure 5:
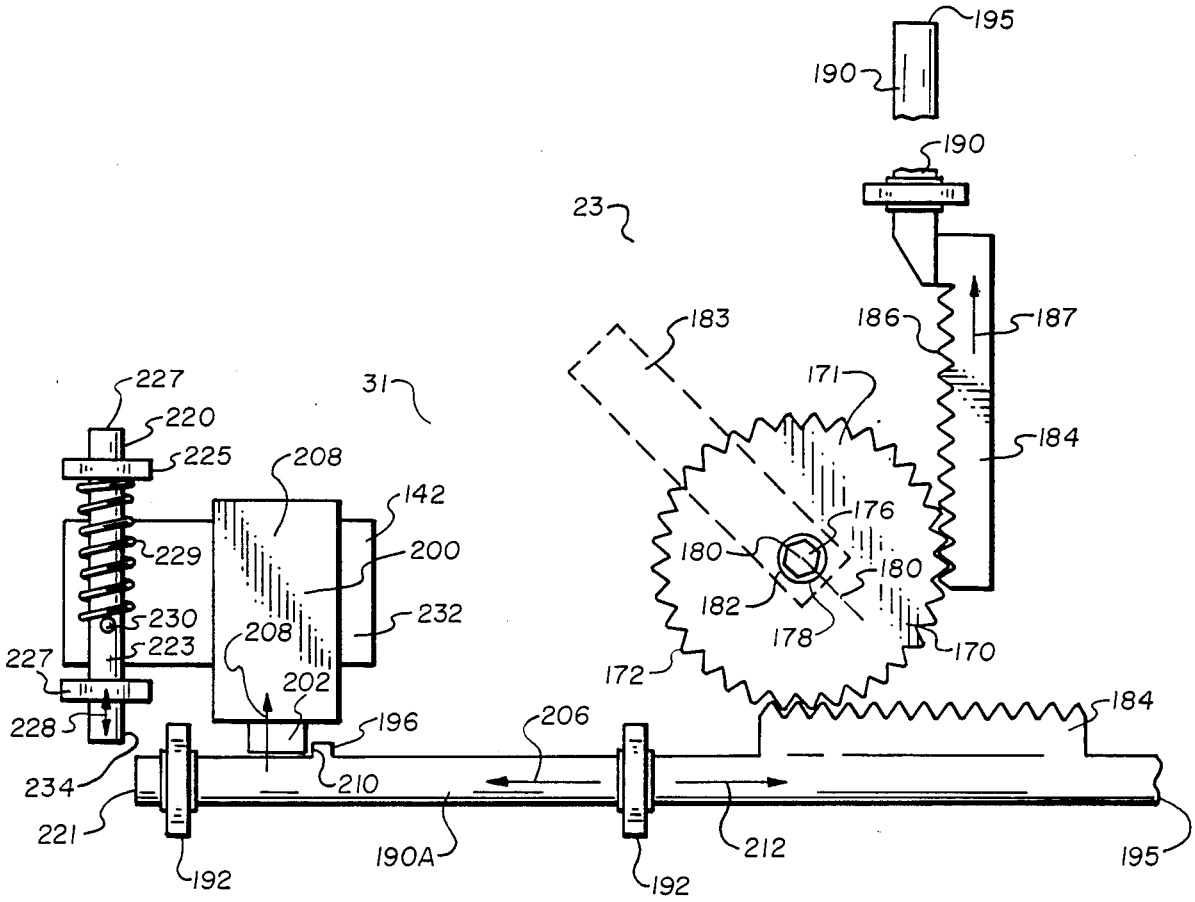
FIG. 5 shows a locking mechanism having a rack and pinion gearing arrangement in conjunction with two extension members adapted to position locking bolts into perpendicularly arranged sides of a security cabinet door.

A second embodiment of the locking mechanism for a lightweight security cabinet is shown in FIG. 5. As shown therein, a first driven gear 170 includes an essentially circular cross-sectioned planar member 171 having a plurality of teeth 172 fixedly mounted about its circumference or perimeter. The first driven gear 170 is rotatably mounted upon the interior wall 31 of door 23. Shaft 176 extends perpendicular from the surface 31 of door 23.

The circular shaft 176, together with gear 170, is made rotatable about an axis 180 which extends perpendicular from the surface 31 of door 23. Shaft 176 is adapted to extend through an aperture 182 within the wall of door 23 and extends through the door so as to be fixedly mounted exterior to the door to a lever-like member 183. Lever member 183 is made and configured to be graspable by the user whereby the user may rotate the shaft 176 about the axis 180 and thereby effect a similar rotational action of the first driven gear 170 about its axis 180 from exterior to the safe.

Positioned proximate to the first driven gear 170 is a plurality of rack-type gears 184. The rack-type gears 184 include a plurality of teeth-like members 186 which are dimensioned and configured to be mechanically cooperable with the teeth 172 which are fitted about the circumference of first driven gear 170.

As shown in FIG. 5, the rack-type gears 184 are oriented essentially at a 90 degree offset from one another such that the displacement of each rack-type gear 184 is in a direction 187 which is essentially perpendicular to the other rack-type gear displacement 188. Each rack-type gear 184 is fixedly mounted on a shaft member, generally 190, which shaft members are supported by channel-like support means 192 which are fixedly mounted to the interior surface 31 of door 23.

The support means 192 may be configured similar to supports 97 as shown in FIG. 3; i.e., the supports 192 are configured to define a channel or aperture 191. The shafts 190 are made slidable or displaceable in aperture 191 in the directions 193 and 194. Directions 193, 194 are essentially parallel to the planar surface 31 of door 23. Shafts 190 are fitted at their tips 195 with elongate shaft members (not shown) such as those shown in FIG. 4, i.e. shaft members 110, 112. These shaft members may be fitted with a plurality of bolt-like members 115. Alternately, the shafts 190 may be configured similarly to shaft 105 shown in FIGS. 3 and 4 wherein each shaft 190 itself extends to the perimeter of the door and the tip of the shaft itself provides the bolt-like means for abutting against the door frame 27.

As shown, shaft 190A is fitted on its surface with an abutment member 196 which extends above the surface of shaft 190A. Abutment member 196 may be of any configuration provided it provides an abutment surface to contact against a bolt 202. Positioned proximate member 196 is a bolt-like locking mechanism 200 which includes a bolt member 202 which is positionable in two distinct positions—a first position as shown in FIG. 5 wherein the bolt member 202 extends sufficiently proximate the shaft 190A such that a displacement of shaft 190A in the direction indicated by arrow 206 is effectually precluded by the abutting action of abutment member 196 against the bolt member 202, and a second position (not shown) which provides for the bolt-like member 202 to be raised upward in the direction indicated by arrow 208 sufficiently such that the surface 210 of bolt member 202 is raised such that abutment member 196 may be displaced in the direction 206 without coming into contact with the surface 210 of bolt 202, i.e. the bolt 202 is raised sufficiently such that the shaft member 190A may slide freely along the direction 206 or alternately direction 212 with no interference or contact with the bolt 202.

A secondary locking means, designated generally 220, is positioned proximate the tip 221 of shaft 190A. Locking mechanism 220 is similar in configuration to secondary securement system 130 shown in FIG. 3; i.e., secondary locking means 220 includes a shaft member 223 which is held in a sliding relationship with support members 225 and 227 such that the shaft member 223 is permitted to slide in a direction, generally 228, which is parallel to the interior face surface 31 of door 23.

A spring 229 is held in compression against support 225 and a support pin 230 which pin 230 is fixedly mounted to shaft 223 and is also mounted, though releaseably mounted, against a plate-like member 232 which extends essentially parallel to the face of the surface 31 of door 23 and is fixedly mounted to locking means 220.

In operation, secondary locking means 220 functions similar to that shown in FIG. 3; i.e., a displacement or inwardly directed motion of locking means 220 serves to displace plate 232 inwardly, thereby separating plate 232 from the pin support 230. Spring 229 exerts its compressive action against pin 230, thereby directing shaft 223 into a position whereby the abutment surface 234 of shaft 223 is brought into contact with the tip 221 of shaft 190A, thereby precluding a further displacement of shaft 190A in the direction indicated by arrow 206.

Figure 2:
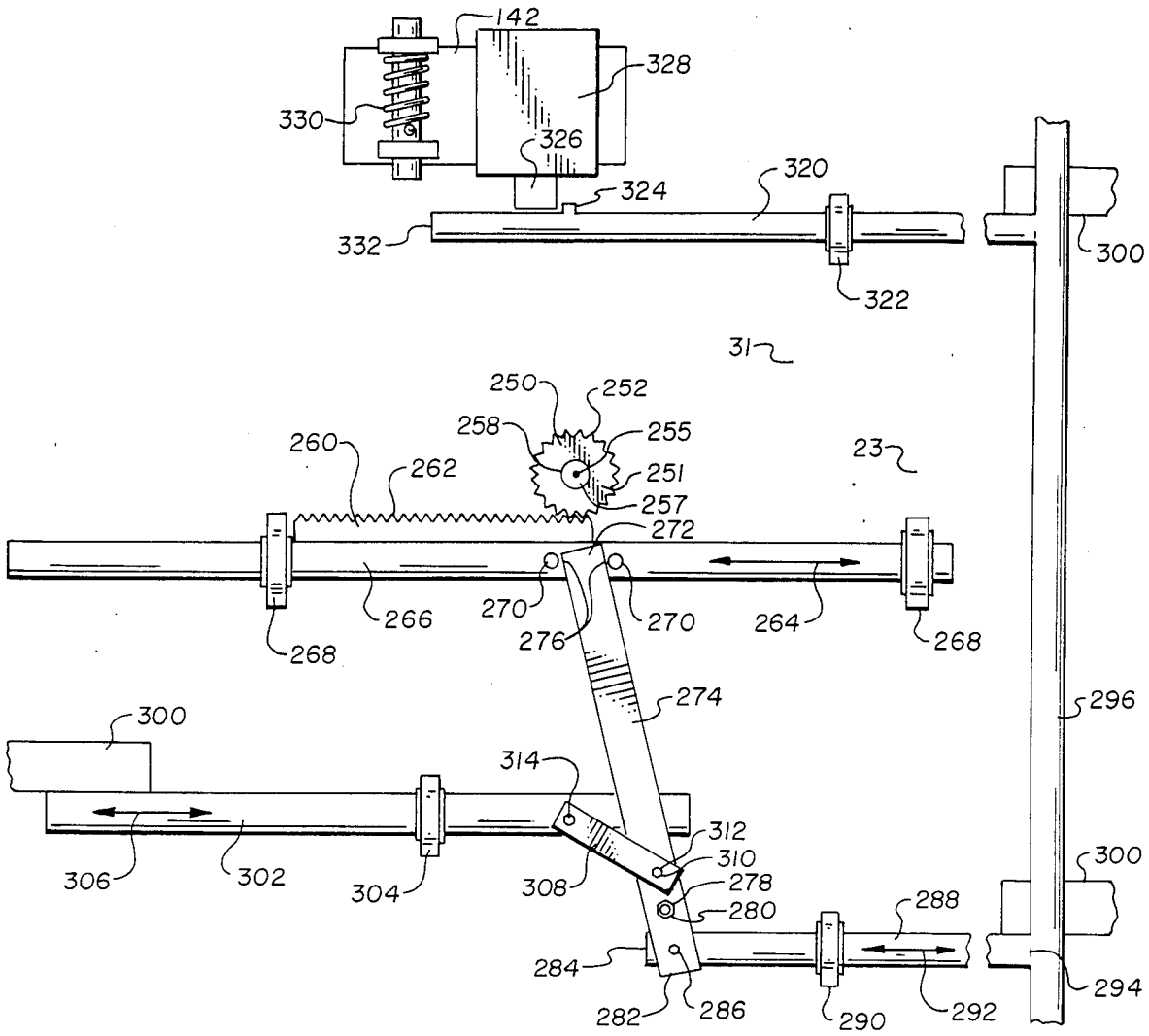
FIG. 2 illustrates a locking mechanism adapted for placement on the interior face of a security cabinet door. As shown, the locking mechanism includes an essentially circular gear positioned in conjunction with a rack-type gear, i.e. a rack-and-pinion-type arrangement. The rack gears are shown as fitted with a series of extension members adapted to position a plurality of bolt members against the marginal front face or frame of a security cabinet door.

A third embodiment of the instant invention is shown in FIG. 2. As shown, a first driven gear 250 is configured as a generally circular cross-sectioned planar member 251 having a plurality of teeth 252 fixedly mounted about the circumference of the circular member 251. This pinion-type gear 250 is made rotatable about an axis 255 which extends essentially perpendicular to the interior surface 31 of door 23.

The first driven gear 250 is fixedly mounted to a shaft 257 which extends essentially perpendicular to the surface 31 of door 23 and passes through an aperture 258 defined within the surface 31 of door 23. Shaft 258 extends through the door 23 to communicate with the exterior of the door 23 and is fixedly mounted proximate the exterior surface 29 of door 30 to an actuation means 39 similar to that shown in FIG. 1. A rotation of actuation means 39 effects a corresponding rotation of first driven (pinion) gear 250.

Positioned proximate the teeth 252 of pinion gear 250 is a rack-type gear 260 which includes a plurality of teeth 262 which are dimensioned and configured to mechanically cooperate with the teeth 252 of pinion gear 250 such that a rotation of pinion gear 250 effects a displacement of the rack-type gear 260 in the direction indicated by arrow 264.

The rack-type gear 260 is fixedly mounted to a shaft member 266 which is held in position by support means 268. Support means 268 in shape and configuration are similar to support means 97 described in FIG. 3. Support means 268 permit a slidable displacement of shaft 266 along the surface 31 of door 23.

Mounted on shaft 266 are a pair of restraining pins 270 which extend outwardly and define a receiving well 272 adapted to receive a shaft member 274. Receiving well 272 may be essentially "U"-shaped in configuration. As shown, shaft member 274 extends within the essentially "U"-shaped recess well defined by pins 270 and the surface of shaft 266, whereby a displacement of shaft 266 in the direction indicated by arrow 264 operates, due to the abutting action of pins 270 against the surface 276 of shaft 274, causes shaft 274 to likewise be displaced.

Shaft 274 is pivotedly mounted to interior surface 31 of door 23 by a cylindrical pin 278 which extends from the surface 31 of door 23 and is housed within an aperture 280 within shaft 274. The motion or displacement of shaft 266 occasions a clockwise, or alternately a counterclockwise, motion of shaft 274 about pivot pin 278.

Shaft 274 is fitted at its distal end 282 with a second pivot pin 284 which passes through an aperture 286 within shaft 274 while simultaneously being connected to a second shaft 288. Shaft 288 is supported by support means 290 which permit shaft 288 to reciprocate in a lateral or linear direction as indicated by arrow 292. Upon shaft 274 being rotated either in a clockwise or alternately a counterclockwise direction about pivot pin 278, the connection of shaft 274 with shaft 288 through means of pivot pin 284 causes shaft 288 to reciprocate in the direction shown by arrow 292. Shaft 288 is fitted at its tip 294 with an elongate shaft-like extension 296 which is fitted with a plurality of bolt-like members 300. In construction, orientation and operation, shaft extension 296 together with bolts 300 are similar to extensions 110, 112 and bolts 115 shown in FIG. 4; i.e., a displacement of shaft 288 operates to effect a displacement of shaft 296, occasioning a positioning of bolts 300 either without or within the perimeter 118 of a door 23 of a lightweight security cabinet.

As shown in FIG. 2, a second shaft-like extension 302 is supported on the interior face 31 of door 23 by a plurality of support means, generally 304, which in configuration are similar to those supports 97 described in the discussion of FIG. 3. Shaft 302 is made reciprocal along lateral or linear directions indicated by arrow 306. Similarly, shaft 302 may be fitted with an extension member 296 (not shown), which extension member 296 likewise includes a plurality of bolt-like members 300 adapted to be positioned proximate the perimeter 118 of a door 23 of a lightweight security cabinet.

Shaft 302 is adapted by the interconnection of shaft 302 with shaft 274 through a linkage member 308. As shown, linkage member 308 is connected to shaft 274 through means of pivoting pin 310 which passes through an aperture 312 within shaft 274. Pivot pin 310 is made and dimensioned such that linkage 308 and shaft 302 are made rotatable about the pivot pin 310. A similar construction is shown as to pivot pin 314 in its pivoted connection of shaft extension 302 and linkage 308. In operation, a displacement of shaft 274 operates not only to displace shaft 288, but further operates to displace shaft 302 in a direction which is essentially 180 degrees from the corresponding displacement of shaft 274 due to the linkage 308 and the pivoting action of shaft 274 about its pivot pin 278.

Elongate extension 296 is connected to a locking shaft, generally 320. Locking shaft 320 is supported slidably by a plurality of supports 322, which in configuration are similar to support members 97. Locking shaft 320 is fitted with an abutment member 324. Abutment member 324 is dimensioned and configured to interact with a bolt means 326 of a locking mechanism 328. The interaction of bolt 326 with abutment member 324 is similar to that which is shown in FIG. 5 and its corresponding locking means bolt member 202 and abutment means 196. Similarly, the secondary locking means, generally 330, is positioned proximate the tip 332 of locking shaft 320 and in operation and structure is similar to secondary locking mechanism 220 shown in FIG. 5.

It is to be understood that the embodiments herein described are merely illustrative of the principals of the invention. Reference herein to the details of the illustrated embodiments is not intended to limit the scope of the claims which in themselves recite those features regarded as essential to the invention.

I claim:

1. A lightweight security cabinet presenting a box-like structure having a full back panel in association with vertical side panels and top and bottom panels positioned perpendicular to said back panel and joined thereto to form an open box-like structure, said security cabinet having a door, having edges, pivotedly mounted within an outlining frame assembly by means of at least one hinge, said door and attendant frame assembly being mounted on said open box-like structure to form a sealable enclosure, said cabinet having a locking mechanism for use on an interior surface of a security cabinet door, said mechanism comprising:

a driven gear mounted rotatably on said interior surface of said cabinet door, said driven gear being driven by an actuation means made manipulatable from the exterior surface of said door;

a rack-type gear mounted slidably along the interior surface of said door, said rack-type gear being mechanically cooperable with said driven gear whereby a rotation of said driven gear displaces said rack-type gear along the interior surface of said door;

a first shaft fixedly mounted on said rack-type gear, said first shaft being slidably supported on said interior door surface by a plurality of first support means whereby a displacement of said rack-type gear effects a linear displacement of said first shaft;

a pair of restraining members spacedly positioned apart on said first shaft and defining a channel therebetween;

a second shaft pivotedly mounted on the interior surface of said cabinet door by a first pivot mounting upstanding from said cabinet door, a portion of said second shaft being positioned within said channel defined by said restraining members whereby a displacement of said first shaft effects a pivoting action of said second shaft about its pivot point;

a third shaft positioned slidably on said interior door surface by a plurality of third support means, said third shaft being pivotedly mounted to a distal end of said second shaft whereby a rotation of said second shaft about its pivot point effects a substantially linear displacement of said third shaft along said interior door surface; and first retaining means mounted on said third shaft and made slidable along the interior door surface of said cabinet, said first retaining means being slidable between two conditions, said conditions being a first condition wherein a portion of said first retaining means does not extend beyond an edge of said door surface and a second condition wherein a portion of said first retaining means is extended beyond the surface of said door whereby the extension of said first retaining means beyond said door edge when the door is in a closed position results in an abutment of said first retaining means against said frame assembly of said security cabinet resulting in said door being made substantially unmovable absent a retraction of said first retaining means;

a fourth shaft, mounted slidably on said interior door surface of said cabinet;

a fifth elongate shaft having a distal end and a proximal end; said fifth shaft member being floatingly mounted to said cabinet solely by mounting said distal end pivotedly on said second shaft member; wherein said entire fifth shaft is free to be displaced about said door surface by the motion of said second and fourth shaft members.

2. The cabinet of claim 1 wherein a second retaining means is mounted on a fourth shaft, said second retaining means being made slidable along the interior surface of said cabinet door, said second retaining means being slidable between two conditions, said conditions being a first condition wherein a portion of said second retaining means does not extend beyond an edge of said door surface and a second condition wherein a portion of said second retaining means is extended beyond the surface of said door whereby the extension of said second retaining means beyond said door edge when said door is in a closed position results in an abutment of said second retaining means against said frame assembly of said security cabinet resulting in said door being made substantially unmovable absent a retraction of said second retaining means.

3. The cabinet of claim 2 wherein a fifth shaft is fixedly mounted on said first retaining means, said fifth shaft being slidably mounted on said interior door surface wherein a locking means made manipulatable from the exterior of said cabinet is made cooperable with said fifth shaft whereby a retraction of said first retaining means from said second condition may be proscribed by said locking means.

* * * * *